US007133027B2

(12) United States Patent
Kimura

(10) Patent No.: US 7,133,027 B2
(45) Date of Patent: Nov. 7, 2006

(54) DISPLAY DEVICE OPERATING IN SUB-FIELD PROCESS AND METHOD OF DISPLAYING IMAGES IN SUCH DISPLAY DEVICE

(75) Inventor: Tohru Kimura, Tokyo (JP)

(73) Assignee: Pioneer Corporation, Tokyo (JP)

( * ) Notice: Subject to any disclaimer, the term of this patent is extended or adjusted under 35 U.S.C. 154(b) by 161 days.

(21) Appl. No.: 10/410,438

(22) Filed: Apr. 10, 2003

(65) Prior Publication Data

US 2003/0193451 A1 Oct. 16, 2003

(30) Foreign Application Priority Data

Apr. 10, 2002 (JP) ..... 2002-107451
Mar. 13, 2003 (JP) ..... 2003-068368

(51) Int. Cl.
*G09G 3/38* (2006.01)

(52) U.S. Cl. ..... 345/163; 315/169.4

(58) Field of Classification Search ..... 345/60, 345/62, 68, 61, 63, 64, 65, 66, 67; 315/169.4
See application file for complete search history.

(56) References Cited

U.S. PATENT DOCUMENTS 6,088,009 A * 7/2000 Moon ..... 345/60
6,476,824 B1 * 11/2002 Suzuki et al. ..... 345/690
6,791,516 B1 * 9/2004 Kang ..... 345/63

FOREIGN PATENT DOCUMENTS

| | | | |
|---|---|---|---|
| JP | 06-259034 | A | 9/1994 |
| JP | 08-23460 | A | 1/1996 |
| JP | 2994630 | B2 | 10/1999 |
| JP | 2001-282183 | A | 10/2001 |

OTHER PUBLICATIONS

Uchiike et al., "All about Plasma Display", *Kogyo-Chousakai*, pp. 163-177.

* cited by examiner

*Primary Examiner*—Richard Hjerpe
*Assistant Examiner*—Jean Lesperance
(74) *Attorney, Agent, or Firm*—Sughrue Mion, PLLC

(57) ABSTRACT

A display device operating in accordance with a sub-field process, includes a first block which varies the number of bits of a received image signal, a second block which calculates an average picture level (APL) of images defined by the image signal transmitted from the first block, a third block which converts the image signal into sub-field coding data, and outputs the sub-field coding data to a display panel, and a fourth block which receives the average picture level from the second block, converts the received average picture level to the number of sustaining pulses, transmits the number of sustaining pulses to the display panel, and transmits the number of sustaining pulses to the third block, wherein the third block selects the number of bits of a signal to be input thereinto, in accordance with the number of sustaining pulses received from the fourth block.

14 Claims, 13 Drawing Sheets

SF1

FIG.4A
PRIOR ART

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 0 | 0 | 0 | 0 | 0 | 0 | 0 | 0 |
| 0 | 1 | 0 | 1 | 1 | 1 | 0 | 0 | 0 | 0 |

SF2

FIG.4B
PRIOR ART

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 0 | 0 | 0 | 0 | 0 | 0 | 0 |

SF3

FIG.4C
PRIOR ART

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

SF4

FIG.4D
PRIOR ART

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

SF5

FIG.4E
PRIOR ART

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

SF6

FIG.4F
PRIOR ART

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

SF7

FIG.4G
PRIOR ART

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

SF8

FIG.4H
PRIOR ART

| | | | | | | | | | |
|---|---|---|---|---|---|---|---|---|---|
| 1 | 1 | 1 | 1 | 1 | 1 | 0 | 0 | 0 | 0 |
| 1 | 0 | 0 | 0 | 0 | 0 | 0 | 0 | 0 | 0 |
| 1 | 0 | 0 | 0 | 0 | 0 | 0 | 0 | 0 | 0 |
| 1 | 0 | 0 | 0 | 0 | 0 | 0 | 0 | 0 | 0 |

DISPLAY DEVICE OPERATING IN SUB-FIELD PROCESS AND METHOD OF DISPLAYING IMAGES IN SUCH DISPLAY DEVICE

BACKGROUND OF THE INVENTION

1. Field of the Invention

The invention relates to a display device such as a display device including a plasma display panel or a digital micro-mirror device, and a method of displaying images in such a display device.

2. Description of the Related Art

Hereinbelow is explained how an image signal is processed in a plasma display panel as a typical example of a digital display device.

FIG. 1 is a block diagram showing how an image signal is processed in a conventional plasma display panel.

The illustrated plasma display panel is comprised of a first block 62 which receives an image signal 61, and applies inverse-gamma process to the received image signal 61, a second block 63 which receives an output signal transmitted from the first block 62, and carries out error diffusion, that is, spatially diffuses gray scales, a third block 64 which receives an output signal transmitted from the second block 63, and calculates an average picture level (APL), a fourth block 65 which receives an output signal transmitted from the third block 64, and converts the received output signal into sub-field (SF) codes, a frame memory 66 which receives an output signal transmitted from the fourth block 65, and outputs an image signal 69, and a fifth block 68 which receives the average picture level 67 from the third block 64, and outputs a sustaining pulse signal 70.

Hereinbelow is explained an operation of the plasma display panel illustrated in FIG. 1.

The first block 62 non-linearly converts the received image signal 61 in association with a gray scale such that the image signal 61 which was made on the assumption that images defined by the image signal 61 were displayed on a cathode ray tube (CRT) is suitable for being displayed in a plasma display panel.

For instance, the image signal 61 is input into the first block 62 as a signal having eight-bit gray scale for each of red (R), green (G) and blue (B), and then, non-linear conversion is applied to the image signal 61 in the first block 62 in accordance with the equation (A).

$$y=x^{2.2} \quad \text{(A)}$$

The first block 62 transmits an output signal having bits or the number of gray scales greater than the same of the image signal 61. On receipt of 8-bit R, G and B signals, the first block 62 generally outputs a 10-bit signal.

The second block 63 receives a signal transmitted from the first block 62. If the first block 62 transmits a 10-bit signal, for instance, the second block 63 spatially diffuses the lowest two bits among 10-bit gray scale resolution, and thus, outputs an 8-bit image signal to the third block 64.

On receipt of the image signal from the second block 63, the third block 64 transmits the received image signal to the fourth block 65 without applying any process to the image signal, and further, calculates an average picture level 67 of images defined by the received image signal.

The average picture level 67 calculated by the third block 64 is transmitted to the fifth block 68. The fifth block 68 converts the average picture level 67 into the number of sustaining pulses in dependence on which a luminance of images is determined, and transmits the number of sustaining pulses to a plasma display panel (not illustrated) as a sustaining pulse output signal 70.

The image signal transmitted to the fourth block 65 from the third block 64 is converted into sub-field coding data in the fourth block 65. A plasma display panel displays images at a certain gray scale defined by the sub-field coding data.

For instance, the fourth block 65 in a general plasma display panel converts an 8-bit image signal into 12 sub-field coding data.

The sub-field coding data is converted into an image output signal 69, and then, transmitted to the plasma display panel through the frame memory 66.

On receipt of the image output signal 69 from the frame memory 66 and further the sustaining pulse output signal 70 from the fifth block 68, the plasma display panel determines both which pixel is to be turned on or off and an intensity of light emission in pixels turned on, based on the signals 69 and 70, thereby displaying images.

Hereinbelow is explained a sub-field process to be carried out in the above-mentioned plasma display panel.

Herein, a sub-field process is a process in which a plurality of binary weighted pictures is overlapped one another time-wise to thereby display moving pictures having an intermediate gray scale.

As illustrated in FIG. 2, there is assumed a plasma display panel having pixels arranged in horizontally ten rows and vertically four columns. It is also assumed that a luminance for red, green and blue is displayed in 8-bit in each of the pixels, and that it is possible to display images at a luminance in 256 gray scales. Hereinbelow is explained a green (G) signal as an example of R, G and B signals.

In FIG. 2, an area A has a signal level of 128 luminance. In other words, a signal of (1000 0000) level is applied to each of pixels in the area A, if the luminance is expressed in a binary code. An area B has a signal level of 127 luminance. That is, a signal of (0111 1111) level is applied to each of pixels in the area B. An area C has a signal level of 126 luminance. That is, a signal of (0111 1110) level is applied to each of pixels in the area C. An area D has a signal level of 125 luminance. That is, a signal of (0111 1101) level is applied to each of pixels in the area D. An area E has a signal level of 0 luminance. That is, a signal of (0000 0000) level is applied to each of pixels in the area E.

Herein, it is assumed that 8-bit signals in each of the pixels are arranged along a time axis in a spatial position of each of the pixels. A sub-field is defined as X/8 wherein X indicates a period of time in which images in a frame are displayed. In other words, in a method of displaying images in accordance with a sub-field process in which a frame or field is divided into a plurality of differently weighted binary images, and the binary images are overlapped one another time-wise to thereby display images, a binary image divided from a frame is defined as a sub-field.

Since each of pixels has 8 bits, one field is divided into first to eighth subfields SF1 to SF8, as illustrated in FIG. 3.

As illustrated in FIGS. 4A to 4H, the first sub-field SF1 is comprised of the lowermost bits in 8-bit signals in each of pixels, arranged in a 10×4 matrix. Similarly, the second sub-field SF2 is comprised of the second lowermost bits in 8-bit signals in each of pixels, arranged in a 10×4 matrix. The third to eighth sub-fields SF3 to SF8 is comprised of bit in the same way as the first or second sub-field SF1 or SF2.

FIG. 5 illustrates plasma display panel drive signals for one field.

As illustrated in FIG. 5, the first to eighth sub-fields SF1 to SF8 are processed in this order in one field.

Hereinbelow is explained how each of the sub-fields is processed, with reference to FIG. 5.

Each of the sub-fields is comprised of a set-up period P1, a writing period P2 and a sustaining period P3.

In the set-up period P1, a pulse is singly applied to a sustaining electrode and a scanning electrode. As a result, preliminary discharge is generated.

In the wiring period P2, scanning electrodes arranged in a horizontal row is scanned in sequence, and writing is carried out only to pixels which received a pulse from a data electrode. For instance, while the first sub-field SF1 is being processed, writing is carried out to pixels indicates as "1", and writing is not carried out to pixels indicated as "0" in the first sub-field SF1 illustrated in FIG. 3.

In the sustaining period P3, a sustaining pulse (a driving pulse) is output to each of the sub-fields in accordance with weighting. In a pixel indicated as "1", that is, to which writing has been carried out, plasma discharge is generated in response to the application of a sustaining pulse thereto. One plasma discharge gives certain brightness to a pixel. Since the first sub-field SF1 is weighted one, there is obtained a brightness of level one. Since the second sub-field SF2 is weighted two, there is obtained a brightness of level two.

As is obvious, the writing period P2 means a period in which a pixel or pixels from which a light is emitted is(are) selected, and the sustaining period P3 means a period in which a light is emitted by the number associated with weighting.

As illustrated in FIG. 5, the first to eighth sub-fields SF1 to SF8 are weighted 1, 2, 4, 8, 16, 32, 64 and 128, respectively. Accordingly, a brightness in each of the pixels can be varied in 256 steps from 0 to 255 (1+2+4+8+16+32+64+128=255).

In the area B illustrated in FIG. 2, a light is emitted from the selected pixels in the first to seventh sub-fields SF1 to SF7, and a light is not emitted in the eighth sub-field SF8. Accordingly, there can be obtained a brightness at 127 level (1+2+4+8+16+32+64=127).

In the area A illustrated in FIG. 2, a light is not emitted in the first to seventh sub-fields SF1 to SF7, and a light is emitted from the selected pixels in the eighth sub-field SF8. Accordingly, there can be obtained a brightness at 128 level.

The number of sub-fields and pseudo-framing noise are closely linked with each other. For instance, pseudo-framing noise can be reduced by increasing the number of sub-fields.

Hereinbelow is explained pseudo-framing noise.

As illustrated in FIG. 6, it is assumed that the areas A, B, C and D are shifted to the right by a distance equal to a width of a pixel in comparison with the arrangement illustrated in FIG. 2. Accordingly, a viewing point of a viewer moves to the right, following the areas A, B, C and D. With the areas A, B, C and D being shifted, three pixels vertically arranged in the area B (three pixels in the area B1 in FIG. 2) are replaced with three pixels vertically arranged in the area A (three pixels in the area A1 in FIG. 6) after one field is past.

When the image illustrated in FIG. 2 is changed into the image illustrated in FIG. 6, the binary data (01111111) in the area B1 in FIG. 2 and the binary data (10000000) in the area A1 in FIG. 6 are recognized by a viewer as data (00000000). That is, the area B1 is not displayed at its original 127 brightness level, but displayed at 0 brightness level. As a result, an apparent dark framing line appears in the area B1.

As mentioned above, when an upper bit is apparently changed to "0" from "1", there appears an apparent dark framing line.

In contrast, when the image illustrated in FIG. 6 is changed to the image illustrated in FIG. 2, a viewer recognizes the area A1 as having data (11111111), based on the binary data (10000000) of the area A1 and the binary data (01111111) of the area B1. That is, this means that an uppermost bit is compulsorily changed to "1" from "0", and hence, the area A1 is not displayed at its original 128 brightness level, but displayed at 255 brightness level about twice greater than 128 brightness level. As a result, an apparent bright framing line appears in the area A1.

As mentioned above, when an upper bit is apparently changed to "1" from "0", there appears an apparent bright framing line.

A mechanism of generation of pseudo-framing noise in a plasma display panel is described in detail in Uchiike et al., "All about Plasma Display", Kogyo-Chousakai, pp. 163–177, for instance.

A framing line appearing in a display screen is called pseudo-framing noise only with respect to moving pictures. Pseudo-framing noise deteriorates display quality.

In general, the number of sub-fields to be displayed in a frame or field in a display device such as a plasma display device or a digital micro-mirror device is dependent on characteristics of the display device. For instance, the number of sub-fields in a plasma display device is generally eleven or twelve. Images are displayed in accordance with the number of sub-fields determined in each of display devices. In order to enhance display quality, there are two methods, in one of which a gray scale control is emphasized, and in the other of which reduction in pseudo-framing noise is emphasized.

In accordance with the former method, it would be possible to display images at 12-bit gray scale in a plasma display panel which can display images in 12 sub-fields, for instance. In accordance with the latter method, it would be possible to display images at 8-bit gray scale, and apply the remainder 4 bits to redundancy coding for the purpose of reducing pseudo-framing noise. Redundancy coding is used generally for reduction in pseudo-framing noise.

As an example of the former method, a method of displaying images, suggested in Japanese Patent Application Publication No. 6-259034 is explained hereinbelow. As an example of the latter method, a display device suggested in Japanese Patent No. 2994630 (Japanese Patent Application Publication No. 11-231825) is also explained hereinbelow.

FIG. 7A is a block diagram of an apparatus for carrying out the method suggested in Japanese Patent Application Publication No. 6-259034.

The illustrated apparatus is comprised of a first circuit 71 for applying gamma-compensation to and changing a level of R, G and B video signals, a field memory 72 electrically connected in series to an output of the first circuit 71, a plasma display panel driver 73, a plasma display panel 74, an integration circuit 75 which receives a luminance signal Y generated based on the R, G and B video signals, and integrating the luminance signal Y to thereby output an average picture level (APL), a control circuit 76 which receives the average picture level (APL) from the integration circuit 75, compares the received average picture level to a predetermined level to thereby group a brightness of images into three levels, transmits a control signal associated with each of the three levels, to a later mentioned second circuit 77, groups each of the levels into three sub-levels, and transmits a control signal associated with each of the three sub-levels, to the first circuit 71, a second circuit 77, and a display control circuit 80.

The second circuit 77 is comprised of a first counter 78 for counting the number of sub-fields, and a second counter 79 for counting the number of display pulses. The second circuit 77 transmits a display timing pulse to the display control circuit 80 at a predetermined timing in accordance with the control signal received from the control circuit 76.

In the display device illustrated in FIG. 7A, a field display period for each of pixels is time-divided into sub-field periods having N-bit gray scales, and the number of display pulses in each of the sub-field periods is weighted for displaying images at intermediate gray scales.

Specifically, the control circuit 76 selects the number of gray scale bits in accordance with a brightness level of displayed images such that the brighter displayed images are, the greater the number of display gray scales is. If the average picture level is smaller than 10%, as shown with the pattern ① in FIG. 7B, a 8-bit gray scale signal having the maximum number of display pulses of 512 is level-changed into a signal having the maximum number of display pulses of 896, and if the average picture level is equal to or greater than 10%, but smaller than 25%, as shown with the pattern ② in FIG. 7B, a 8-bit gray scale signal having the maximum number of display pulses of 512 is changed in level into a signal having the maximum number of display pulses of 640.

In accordance with the display device illustrated in FIG. 7A, the number N of sub-fields is switched into a smaller one, and hence, the number of addressing periods is reduced, in a dark scene in which an average picture level is low. As a result, a maximum of a display luminance is not reduced even in a dark scene, and hence, a contrast ratio is not reduced. In the display device illustrated in FIG. 7A, the number of sub-fields is made smaller for images having a smaller average picture level or darker images, to thereby make a maximum of display gray scale greater, and a gray scale of an output signal transmitted from the first circuit 71 is arbitrarily changed, ensuring that images are displayed at gray scales with high quality.

FIG. 8 is a block diagram of a display device suggested in Japanese Patent No. 2994630.

The illustrated display device is comprised of a first circuit 81 which receives a vertical synchronization signal and a horizontal synchronization signal, and outputs a timing pulse signal, an analog-digital (A/D) converter 82 which converts analog R, G and B signals into digital R, G and B signals, a first device 83 which applies inverse-gamma compensation to the analog-digital converted R, G and B signals, a second device 84 which delays the R, G and B signals to which the inverse-gamma compensation has been applied, by one field, a multiplier 85 which receives the R, G and B signals having been delayed by a field, and a later mentioned constant-multiplication coefficient A, and multiplies by them each other, a peak level detector 93 which detects a brightest peak in a field, an average level detector 92 which calculates an average of a brightness in a field, a third device 94 which receives a peak level signal transmitted from the peak level detector 93 and an average level signal transmitted from the average level detector 92, and determines four parameters (a weighting number N, a constant-multiplication coefficient A of the multiplier 85, the number Z of sub-fields, the number K of gray scale display points), based on a combination of the signals, a fourth device 86 which receives the number K of gray scale display points from the third device 94, and converts a brightness signal expressed in a certain fineness, into a gray scale display point closest to the brightness signal, a fifth device 87 which receives the number Z of sub-fields and the number K of gray scale display points from the third device 94, and converts a 8-bit signal transmitted from the fourth device 86, into a Z-bit signal, a sixth device 95 which receives the weighting number N, the number Z of sub-fields and the number K of gray scale display points from the third device 94, and determines the number of sustaining pulses necessary for each of sub-fields, a seventh device 88 which determines the number of sustaining pulses to be transmitted in a sustaining period P3, in accordance with a signal transmitted from the sixth device 95, a detector 96 which detects a vertical synchronization frequency, a second circuit 89 for driving data electrodes, a third circuit 90 for driving scanning and sustaining electrodes, and a plasma display panel (PDP) 91.

In the display device illustrated in FIG. 8, for instance, when the average level detector 92 detects a high average level, the number Z of sub-fields is increased and the weighting number N is reduced for preventing an increase in both power consumption and a temperature of the plasma display panel 91. It would be also possible to reduce a pseudo-framing line by increasing the number Z of sub-fields.

When the average level detector 92 detects a low average level, the number Z of sub-fields is reduced, and the number of writing in a field is also reduced. Time obtained by reducing the numbers can be used for increasing the weighting number N. Accordingly, it would be possible to display images brightly even in darkness.

As mentioned earlier, the display device illustrated in FIG. 7A makes great account of enhancement in gray scale characteristics, and accordingly, does not always deal with the pseudo-framing line problem.

In contrast, the display device illustrated in FIG. 8 makes great account of reduction in a pseudo-framing line, and does not make particular attempt to enhance gray scale characteristics.

Herein, there is considered a scene having a low average picture level, for instance, a scene in which a crow flies in the night darkness under a full moon.

In accordance with the display device illustrated in FIG. 7A, a moon which can raise a maximum luminance is displayed at a high luminance, and it would be possible to display the scene at a high contrast. However, since the display device illustrated in FIG. 7A increases the number of gray scales and concurrently reduces the number of sub-fields, a pseudo-framing line significantly deteriorates images displayed.

In accordance with the display device illustrated in FIG. 8, a moon can be displayed at a high luminance, since it would be possible to raise a maximum luminance by increasing the weighting number N, ensuring it possible to display the scene at a high contrast. However, the display device illustrated in FIG. 8 reduces the number Z of sub-field in displaying images, and hence, images are deteriorated by a pseudo-framing line. In addition, since the number of gray scales is kept fixed, it would be difficult to distinguish a crow and the night darkness from each other in comparison with the display device illustrated in FIG. 7A.

Hence, an object of the present invention is to make it possible to distinguish a crow and the night darkness from each other, and prevent pseudo-framing characteristic from deteriorating, even in displaying images having a low average picture level.

Analyzing various pictures in TV programs or movies, the inventor had found the following fact.

In a scene having a low average picture level, it is necessary in a dark area to increase the number of gray scales for distinguishing slight differences among gray scales from one another. In images displayed in a plasma display panel, a viewer can scarcely find a pseudo-framing line, even if images are moving. In a scene having a low average picture level, a pseudo-framing line is sometimes conspicuous, if images displayed in a bright area move. However, in a scene having a low average picture level, such images displayed in a bright area scarcely move in such a speed that a pseudo-framing line is conspicuous.

Herein, there is considered again a scene in which a crow flies in the night darkness under a full moon.

It is assumed in the scene that a moon moves at such a speed that a pseudo-framing line is conspicuous and a viewer can follow the moon with his/her eyes. In the display device illustrated in FIG. 7A, a pseudo-framing line would be remarkably conspicuous around the moon. In the display device illustrated in FIG. 8, it would not be possible to distinguish the crow and the night darkness from each other.

Japanese Patent Application Publication No. 8-23460 has suggested a circuit for carrying out dynamic gamma-compensation, including first means for dividing image level of an input signal into a plurality of sub-levels, second means for calculating a degree in each of the sub-levels, and third means for grouping the degrees of each of the sub-levels into a plurality of levels.

Japanese Patent Application Publication No. 2001-282183 has suggested a gray scale controller in a plasma display panel, including a detecting circuit which monitors M-bit digital video signals in N frames, checks whether a bit is vacant in the monitored frame in an order from an uppermost bit to a lowermost bit, and transmits an output bit selecting signal associated with a vacant bit and a table switching signal, a selector which outputs bits from which vacant bits are removed from M bits and which are arranged sequentially from an uppermost bit to a lower bit, the bits being smaller than M bits and being output in accordance with the output bit selecting signal, a memory storing a plurality of tables used for determining a weighting for each of sub-frames in the plasma display panel, the tables being switched in accordance with the table switching signal, and an interface which makes access to the memory, controls a sustaining pulse in each of the sub-frames, and transmits a light-emission pattern to a driver in a next stage.

SUMMARY OF THE INVENTION

In view of the above-mentioned problems in the conventional display devices, it is an object of the present invention to provide a display device and a method of displaying images both of which are capable of reducing pseudo-framing lines and enhancing gray scale characteristics.

In one aspect of the present invention, there is provided a display device which display images in accordance with a sub-field process, which determines the number of bits of an output signal transmitted after inverse-gamma processed and the number of bits of a signal to be sub-field coded, in accordance with the number of sustaining pulses calculated, based on an average picture level (APL) of an input image signal.

There is further provided a display device which displays images in accordance with a sub-field process, including (a) a first block which receives an image signal therein, varies the number of bits of the received image signal, and outputs the image signal, (b) a second block which calculates an average picture level (APL) of images defined by the image signal transmitted from the first block, (c) a third block which receives the image signal from the second block, converts the received image signal into sub-field coding data, and outputs the sub-field coding data to a display panel, and (d) a fourth block which receives the average picture level from the second block, converts the received average picture level to the number of sustaining pulses, transmits the number of sustaining pulses to the display panel as a sustaining pulse output signal, and transmits the number of sustaining pulses to the third block, wherein the third block selects the number of bits of a signal to be input thereinto, in accordance with the number of sustaining pulses received from the fourth block.

The display device may further include a fifth block which receives the image signal from the first block, applies a signal process to lower bits of the image signal for spatially diffusing gray scales of images, and outputs the image signal to the third block, wherein the first block selects the number of bits of a signal to be output therefrom, in accordance with the number of sustaining pulses received from the fourth block.

For instance, as the signal process for spatially diffusing a gray scale of images, error-diffusion process or dither process may be carried out.

It is preferable that assuming that the number of sustaining pulses is equal to A, the number of bits of a signal to be input into the first block is set equal to or greater than the number of bits of a signal to be input into the first block which the latter number is determined when the number of sustaining pulses is equal to B smaller than A (B<A).

This ensures it possible to display images at a maximum gray scale which the sustaining pulses can accomplish, or at a gray scale close to the maximum gray scale. As a result, it would be possible to clearly display a crow flying in the darkness even in a dark scene having a low average picture level, by increasing the number of gray scales to make a difference between the gray scales in a dark scene.

It is preferable that assuming that the number of sustaining pulses is equal to A, the number of bits of a signal to be output from the first block is set equal to or greater than the number of bits of a signal to be output from the first block which the latter number is determined when the number of sustaining pulses is equal to B smaller than A (B<A), and the number of bits of a signal to be input into the third block is set equal to or greater than the number of bits of a signal to be input into the first block which the latter number is determined when the number of sustaining pulses is equal to B smaller than A (B<A).

The number of bits of a signal output from the first block and the number of bits of a signal input into the third block are controlled in accordance with the number of the sustaining pulses, ensuring that images are displayed at a gray scale with high accuracy.

For instance, the number of sub-fields may be determined in accordance with the number of sustaining pulses.

It is preferable that assuming that the number of sustaining pulses is equal to A, the number of sub-fields is set equal to or greater than the number of sub-fields determined when the number of sustaining pulses is equal to B smaller than A (B<A).

In a scene which is all white and hence has a high average picture level, the number of sustaining pulses is small. Hence, if the number of sub-fields is constant, it would be possible to suppress generation of a pseudo-framing line to a high degree, since a difference between the number of bits of a signal input into the third block and the number of bits in the sub-field is great. In contrast, in a scene which is dark and hence has a low average picture level, the number of sustaining pulses is great. Hence, if the number of sub-fields is constant, generation of a pseudo-framing line can be suppressed to a small degree, since a difference between the number of bits of a signal input into the third block and the number of bits in the sub-field is small. Accordingly, it is preferable to increase the number of sub-fields as much as possible in accordance with the number of the sustaining pulses.

The number of sub-fields may be fixed regardless of said number of sustaining pulses.

In a scene which is all white and hence has a high average picture level, the number of sustaining pulses is small, and hence, a difference between the number of bits of a signal input into the third block and the number of bits in the sub-field is great. As a result, it would be possible to suppress generation of a pseudo-framing line to a high degree. In contrast, in a scene which is dark and hence has a low average picture level, the number of sustaining pulses is great, and hence, a difference between the number of bits of a signal input into the third block and the number of bits in the sub-field is small. As a result, generation of a pseudo-framing line can be suppressed to a small degree. However, such a scene scarcely moves at such a speed that a pseudo-framing line is conspicuous, images are less influenced by pseudo-framing lines in comparison with normal images.

For instance, the fifth block carries out Floyd-Steinberg type error diffusion.

The present invention may be applied to a display device operating in accordance with a sub-field process. For instance, the present invention may be applied to a plasma display panel (PDP), a digital micro-mirror device (DMD) or an electroluminescence (EL) device. Herein, an electroluminescence (EL) device is meant to include both an organic EL device and an inorganic EL device.

It is preferable that the number of bits of a signal to be output after inverse-gamma processed and the number of bits of a signal to be sub-field coded are altered only when a scene defined by the received image signal changes.

It is preferable that the number of bits of a signal to be output after inverse-gamma processed and the number of bits of a signal to be sub-field coded are altered when an average picture level of the received image signal varies to a degree beyond a predetermined threshold.

In another aspect of the present invention, there is provided a method of displaying images in a display device which displays images in accordance with a sub-field process, including the steps of (a) calculating the number of sustaining pulses, based on an average picture level (APL) of input image signal, (b) determining the number of bits of a signal to be output after inverse-gamma processed, in accordance with the number of sustaining pulses, and (c) determining the number of bits of a signal to be sub-field coded, in accordance with the number of sustaining pulses.

The method may further include the step of, assuming that the number of sustaining pulses is equal to A, setting the number of bits of a signal to be sub-field coded equal to or greater than the number of bits of a signal to be sub-field coded which the latter number is determined when the number of sustaining pulses is equal to B smaller than A (B<A).

The method may further include the step of, assuming that the number of sustaining pulses is equal to A, setting the number of bits of a signal having been inverse-gamma processed equal to or greater than the number of bits of a signal having been inverse-gamma processed which the latter number is determined when the number of sustaining pulses is equal to B smaller than A (B<A), and setting the number of bits of a signal to be sub-field coded equal to or greater than the number of bits of a signal to be sub-field coded which the latter number is determined when the number of sustaining pulses is equal to B smaller than A (B<A).

The method may further include the step of determining the number of sub-fields by which a signal is to be sub-field coded, in accordance with the number of sustaining pulses.

The method may further include the step of, assuming that the number of sustaining pulses is equal to A, setting the number of sub-fields equal to or greater than the number of sub-fields determined when the number of sustaining pulses is equal to B smaller than A (B<A).

It is preferable that the number of sub-fields by which a signal is to be sub-field coded is fixed regardless of the number of sustaining pulses.

There is further provided a method of displaying images in a display device which displays images in accordance with a sub-field process, including the steps of (a) varying the number of bits of a received image signal, (b) calculating an average picture level (APL) of images defined by the image signal resulted from the step (a), (c) converting the image signal resulted from the step (b) into sub-field coding data, and outputting the sub-field coding data to a display panel, (d) converting the average picture level into the number of sustaining pulses, and (e) selecting the number of bits of the image signal resulted from the step (b), in accordance with the number of sustaining pulses.

The method may further include the steps of (f) spatially diffusing lower bits of the image signal resulted from the step (a), and (g) selecting the number of bits of a signal to be output in the step (a), in accordance with the number of sustaining pulses.

For instance, Floyd-Steinberg type error diffusion is carried out as error diffusion in the step (f).

It is preferable that the number of bits of a signal to be output after inverse-gamma processed and the number of bits of a signal to be sub-field coded are altered only when a scene defined by the received image signal changes.

It is preferable that the number of bits of a signal to be output after inverse-gamma processed and the number of bits of a signal to be sub-field coded are altered when an average picture level of the received image signal varies to a degree beyond a predetermined threshold.

In methods of driving a display device, profiles of pixels in which a light is emitted in a frame may be different from one another in dependence on a difference in sub-field coding. If scenes having such different profiles are switched frame by frame, a flicker may be observed on a display screen for quite a short period of time. This behaves as a display shock, which is not preferable in displaying images.

When a scene is changed into another one, for instance, when a scene is suddenly changed into another one, when a scene displaying bright outdoor images is changed into a scene displaying dark indoor images, or when a scene is changed into a quite different scene such as commercial messages, the scene before changed contains display shock therein. Accordingly, in a method of driving a display device where profiles of pixels in which a light is emitted in a frame are different from one another in dependence on a difference in sub-field coding, it would be possible to reduce display shock in displayed images, by detecting when a scene is changed to another one, and reducing the present invention into practice when a scene is changed to another one. For instance, it would be possible to detect a scene being changed, by monitoring much variance in an average picture level of input image signals, that is, monitoring that an average picture level of input image signals varies beyond a predetermined threshold.

The above-mentioned method of displaying images in a display device in accordance with a sub-field process may be embodied as software. Specifically, the method of displaying images may be embodied as a computer program, in which case, the method may be carried out or the performances the above-mentioned display device presents may be obtained by executing the computer program in a computer.

For instance, the present invention provides a program for causing a computer to carry out the above-mentioned method of displaying images in a display device, in accordance with the present invention.

As an alternative, the present invention may be embedded as a program for causing a computer to act as the above-mentioned display device in accordance with the present invention.

The above-mentioned program may be presented through a recording medium readable by a computer.

The advantages obtained by the aforementioned present invention will be described hereinbelow.

In accordance with the present invention, as will be explained in a later mentioned first embodiment, quality of images displayed on a plasma display panel is controlled by switching sub-field coding without changing the number of sub-fields, specifically, by changing the number of bits of a signal to be sub-field coded. The number of bits of a signal to be sub-field coded corresponds to the number of gray scales. The number of bits of a signal to be sub-field coded, to be determined when the number of sustaining pulses is relatively great, is determined equal to or greater than the number of bits of a signal to be sub-field coded, to be determined when the number of sustaining pulses is relatively small. This ensures that the number of gray scales is increased to make a gray scale difference in a dark scene having a small average picture level, and as a result, it would be possible to clearly display an image such as a crow flying in the darkness.

If the number of bits of a signal to be sub-field coded is increased, a difference between the number of bits of a signal to be sub-field coded and the number of sub-fields is reduced, resulting in that redundancy in sub-field coding is reduced, and thus, generation of a pseudo-framing lines is less prevented. In order to avoid this problem, the number of sub-fields may be determined based on the number of sustaining pulses, as will be explained in a later mentioned second embodiment. Specifically, it would be possible to prevent reduction in suppression of generation of pseudo-framing lines by setting the number of sub-fields to be determined when the number of sustaining pulses is relatively great, to be equal to or greater than the number of sub-fields to be determined when the number of sustaining pulses is relatively small.

In accordance with the present invention, it is possible to accomplish both enhancement in gray scale characteristics and reduction in pseudo-framing lines, ensuring that a maximum gray scale resolution can be accomplished in line with characteristics of a plasma display panel, and hence, images can be displayed with enhanced quality.

In methods of driving a display device, profiles of pixels in which a light is emitted in a frame may be different from one another in dependence on a difference in sub-field coding. In such methods, a scene change in input images may be detected, and only when such a scene change occurs, the display device or the method in accordance with the present invention may be reduced into practice. This ensures it possible to soften a screen shock in displaying images which screen shock is unavoidable when the present invention is reduced into practice.

The above and other objects and advantageous features of the present invention will be made apparent from the following description made with reference to the accompanying drawings, in which like reference characters designate the same or similar parts throughout the drawings.

BRIEF DESCRIPTION OF THE DRAWINGS

FIGS. 4A to 4H are plan views of each of the first to eighth sub-fields SF1 to SF8.

DESCRIPTION OF THE PREFERRED EMBODIMENTS

Preferred embodiments in accordance with the present invention will be explained hereinbelow with reference to drawings.

[First Embodiment]

Figure 1:
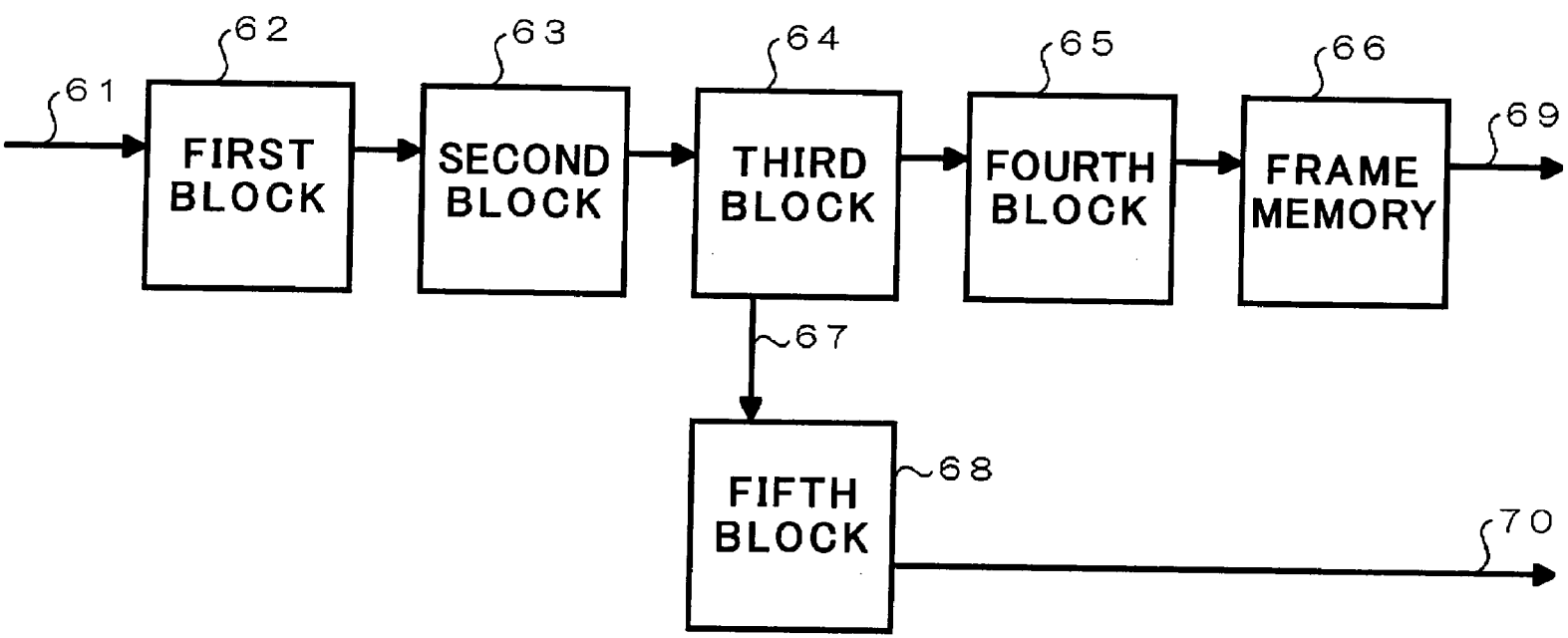
FIG.1 PRIOR ART
FIG. 1 is a block diagram of a conventional plasma display panel.
Figure 2:
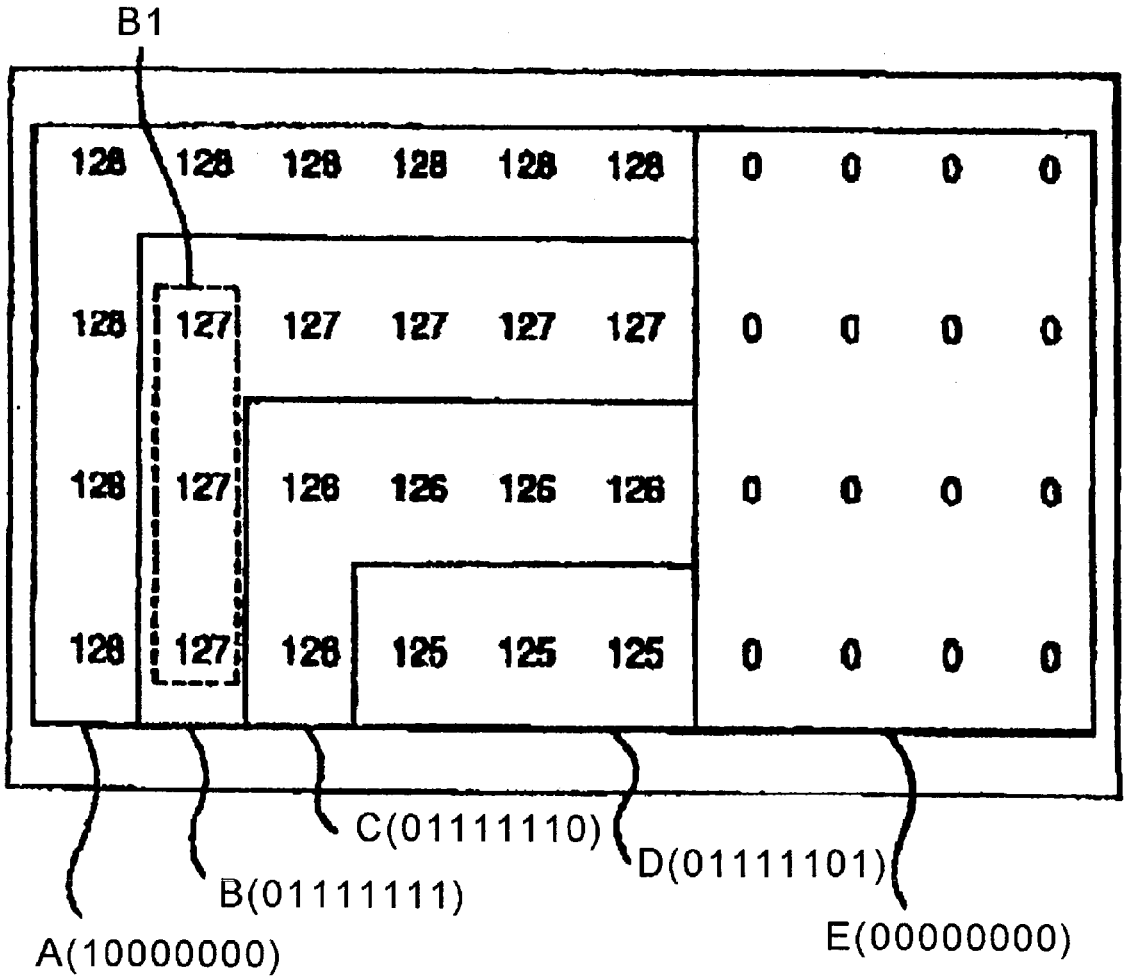
FIG.2 PRIOR ART
FIG. 2 illustrates an example of a plasma display panel having pixels arranged in a predetermined pattern.
Figure 3:
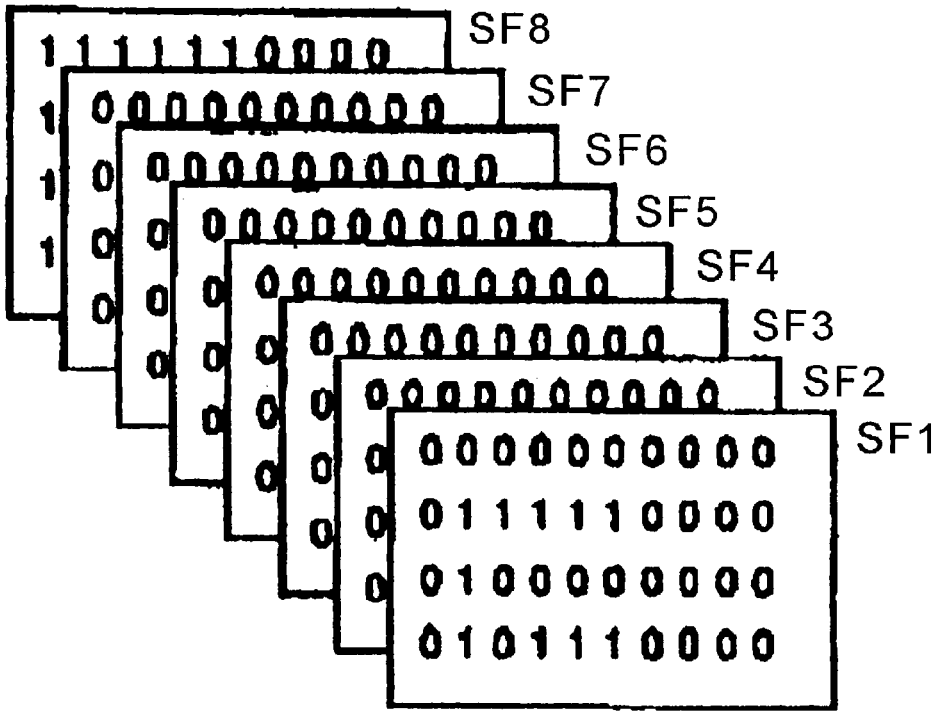
FIG.3 PRIOR ART
FIG. 3 is a perspective view of the first to eighth sub-fields SF1 to SF8.
Figure 5:
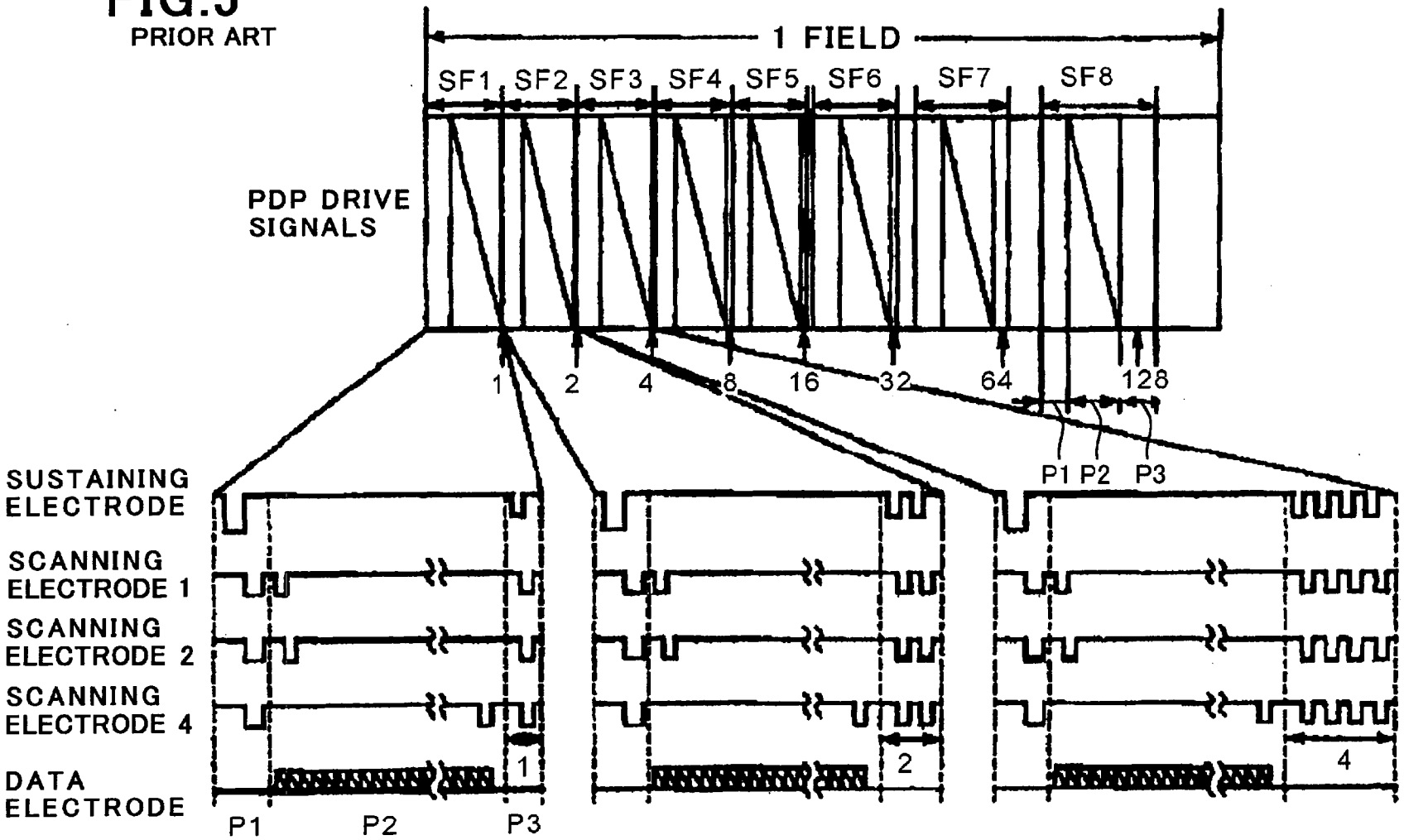
FIG.5 PRIOR ART
FIG. 5 is a timing chart showing drive signals for driving a plasma display panel in a field.
Figure 6:
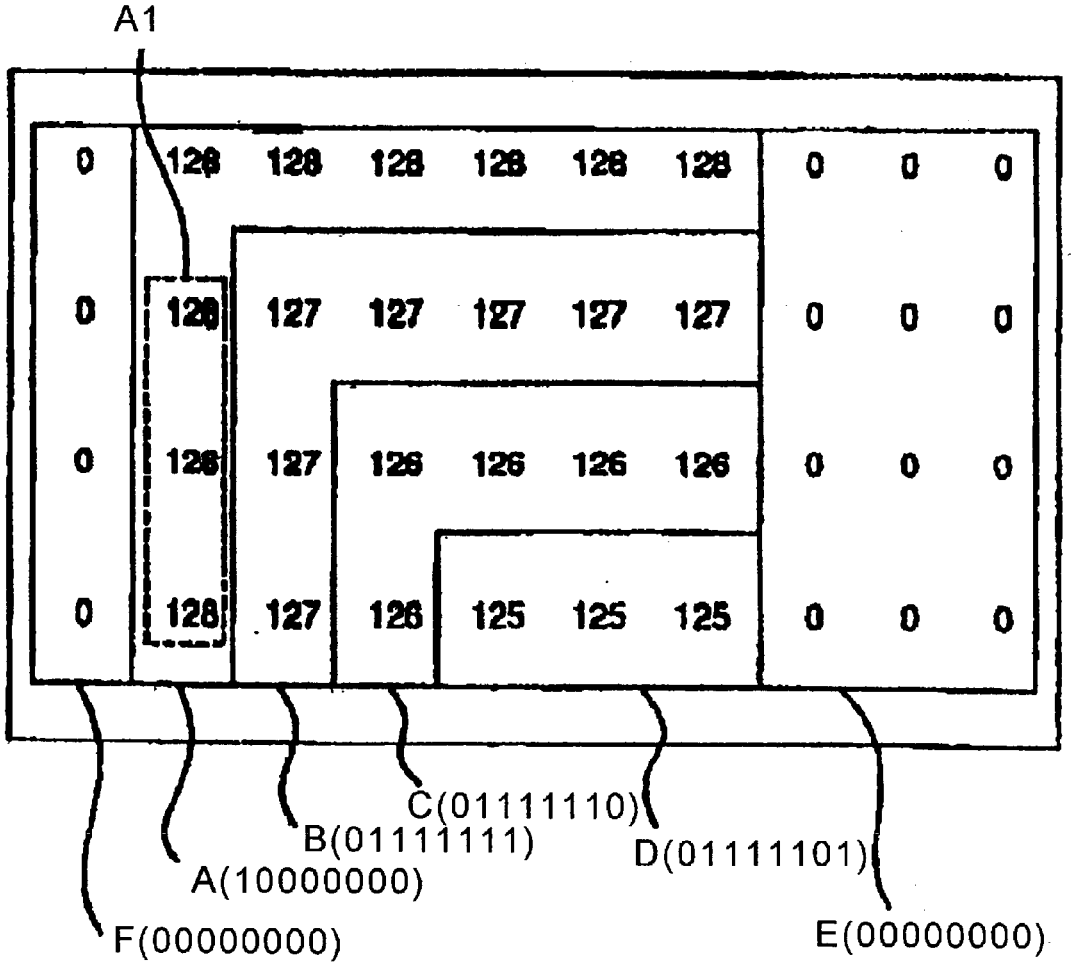
FIG.6 PRIOR ART
FIG. 6 illustrates a plasma display panel in which the areas A, B and C are shifted to the right by a pixel width in comparison with the plasma display panel illustrated in FIG. 2.
Figure 7A:
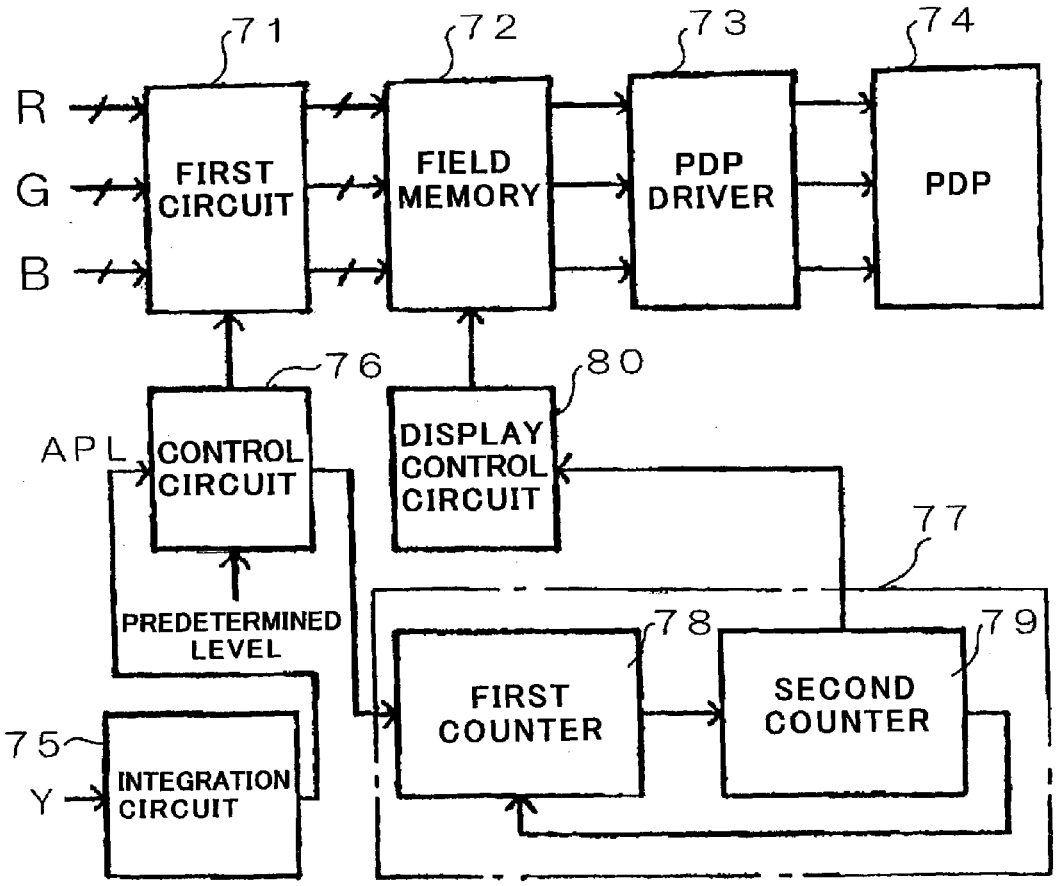
FIG.7A PRIOR ART
FIG. 7A is a block diagram of an apparatus for carrying out the method suggested in Japanese Patent Application Publication No. 6-259034.
Figure 7B:
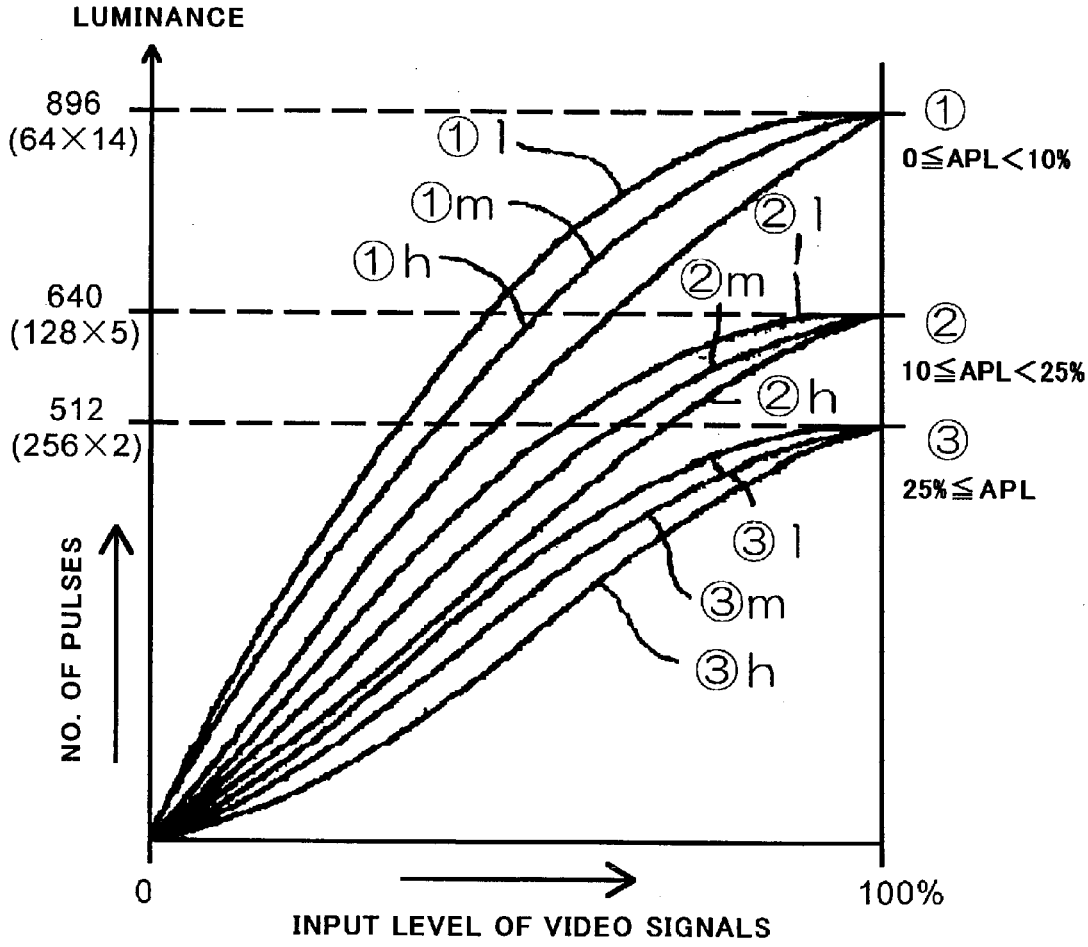
FIG.7B PRIOR ART
FIG. 7B is a graph showing a relation between the number of pulses and input level of video signals, in the apparatus illustrated in FIG. 7A.
Figure 8:
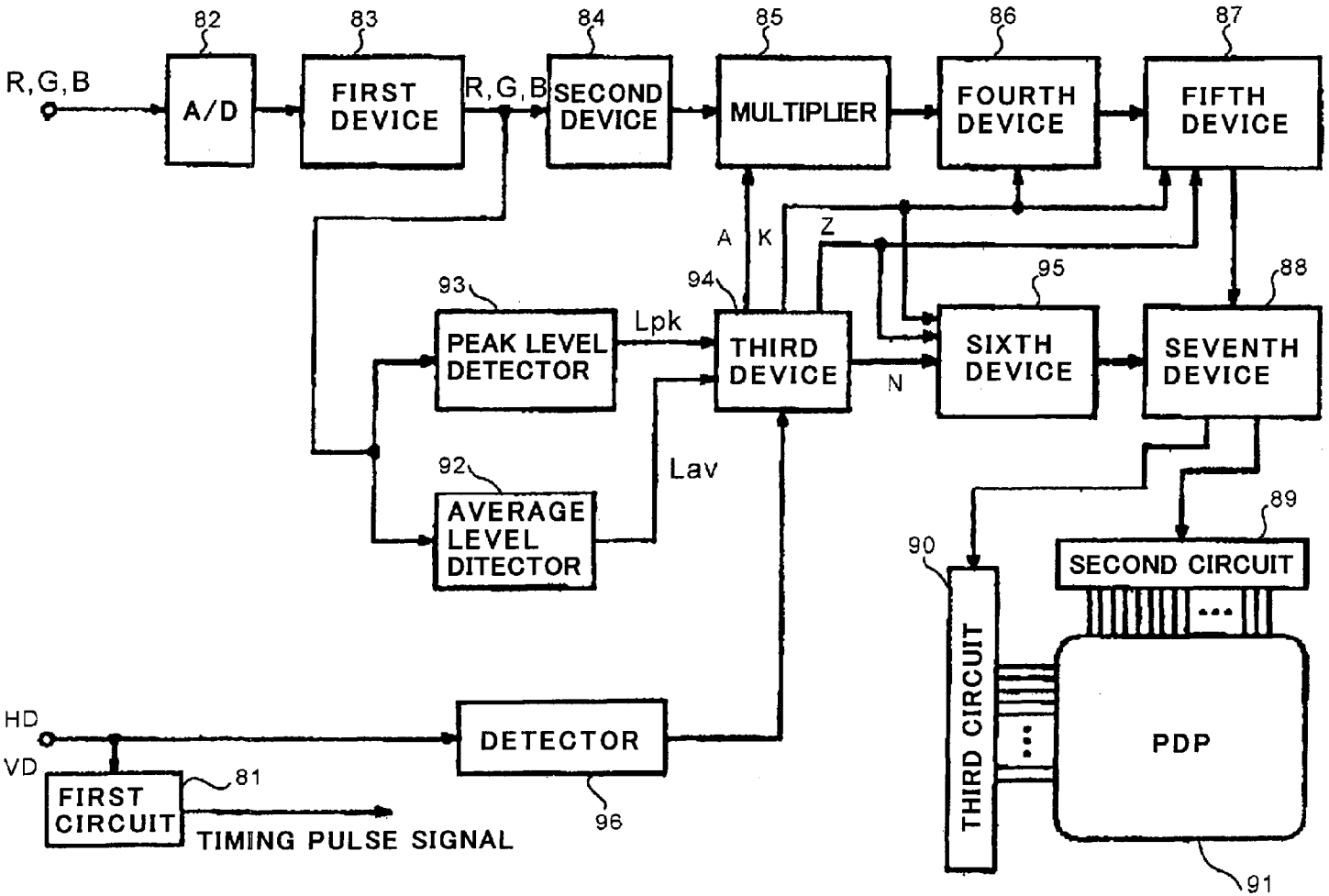
FIG.8 PRIOR ART
FIG. 8 is a block diagram of a display device suggested in Japanese Patent No. 2994630.
Figure 9:
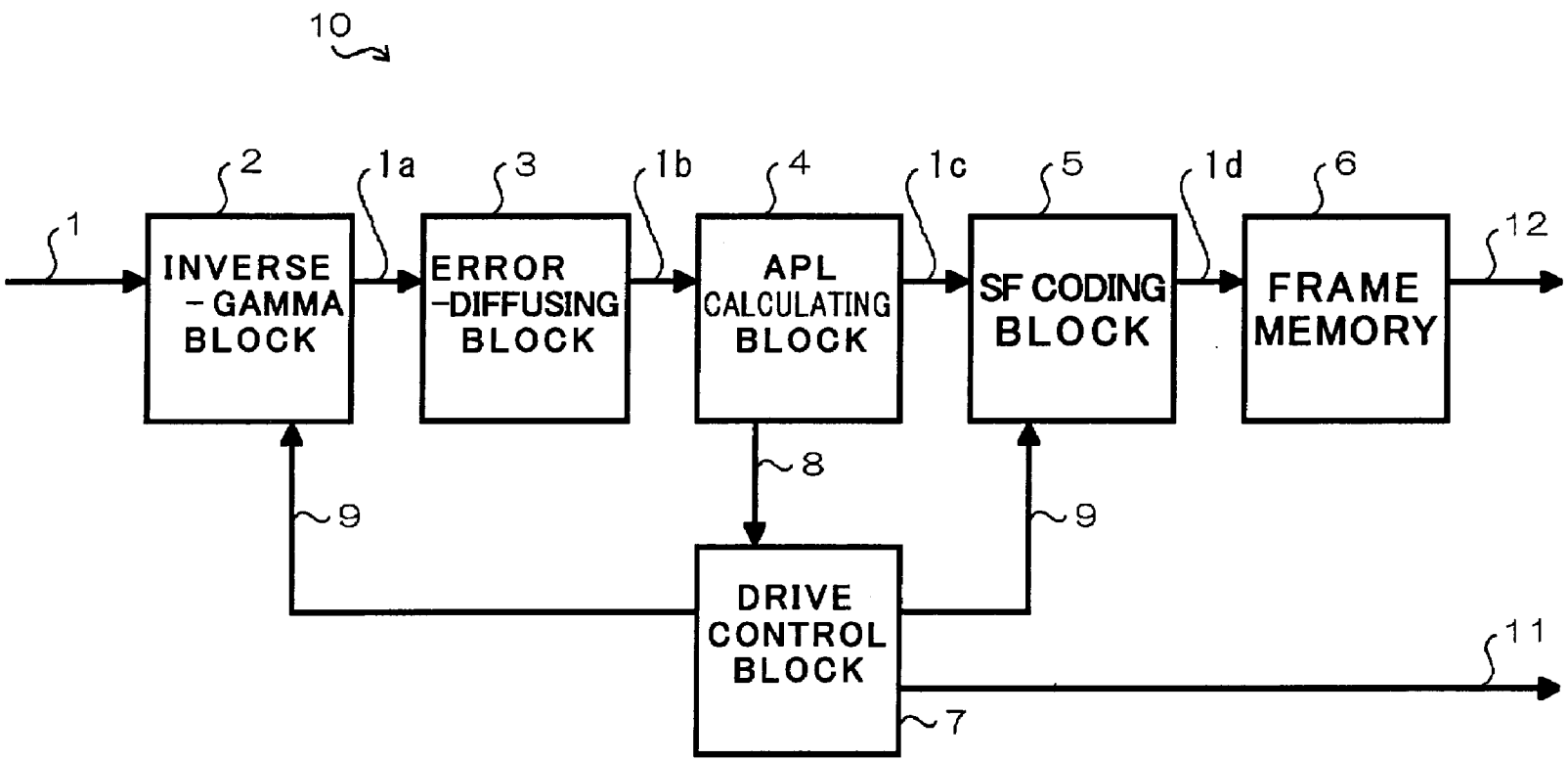
FIG. 9 is a block diagram of a display device in accordance with the first embodiment of the present invention.

FIG. 9 is a block diagram of a display device 10 in accordance with the first embodiment of the present invention. The display device 10 in the first embodiment is applied to a plasma display panel (PDP).

As illustrated in FIG. 9, the display device 10 is comprised of an inverse-gamma block 2 which receives an image signal 1, applies inverse-gamma process to the received image signal 1, that is, changes the number of bits of the received image signal 1, and outputs at least one image signal 1*a*, an error-diffusing block 3 which receives the image signal 1*a* transmitted from the inverse-gamma block 2, and carries out error diffusion, that is, error-diffuses lower bits of the received image signal 1*a*, an APL calculating block 4 which receives an image signal 1*b* transmitted from the error-diffusing block 3, and calculates an average picture level (APL) of images indicated by the received image signal 1*b*, a sub-field coding block 5 which receives an image signal 1*c* transmitted from the APL calculating block 4, and converts the received image signal 1*c* into sub-field (SF) codes, a frame memory 6 which receives an image signal 1*d* transmitted from the sub-field coding block 5, and outputs an image signal 12 to a display panel (not illustrated), and a drive control block 7 which receives an average picture level 8 from the APL calculating block 64, converts the received average picture level 8 into the number 9 of sustaining pulses, and transmits the number 9 of sustaining pulses to the display panel (not illustrated) as a sustaining pulse output signal 11, and further transmits the number 9 of sustaining pulses to both of the inverse-gamma block 2 and the sub-field coding block 5.

The inverse-gamma block 2 receives the number 9 of sustaining blocks from the drive control block 7, and determines the number of bits of the output signal 1*a* in accordance with the received number 9 of sustaining blocks.

The sub-field coding block 5 receives the number 9 of sustaining blocks from the drive control block 7, and determines the number of bits of a signal to be received therein, in accordance with the received number 9 of sustaining blocks.

Though the display device 10 in accordance with the first embodiment is designed to include the error-diffusing block 3 which carries out error diffusion, the display device 10 may be designed to include a circuit or a device in place of the error-diffusing block 3, if it spatially diffuses a gray scale of image. For instance, a dither block carrying out a dither process may be substituted for the error-diffusing block 3.

As an alternative, the error-diffusing block 3 may be omitted, in which case, the inverse-gamma block 2 transmits the output signal 1*a* directly to the APL calculating block 4.

Figure 10:
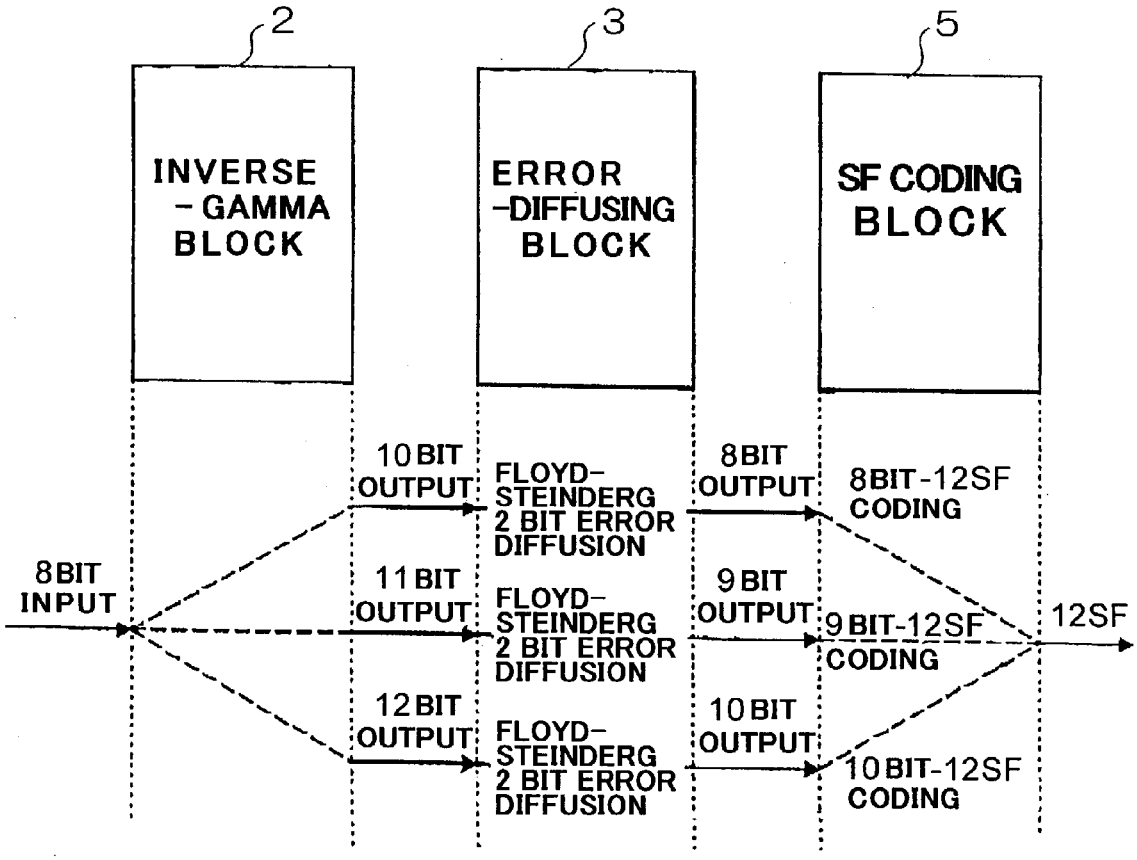
FIG. 10 is a signal chart showing an operation of the blocks partially constituting the display device illustrated in FIG. 9.
Figure 11:
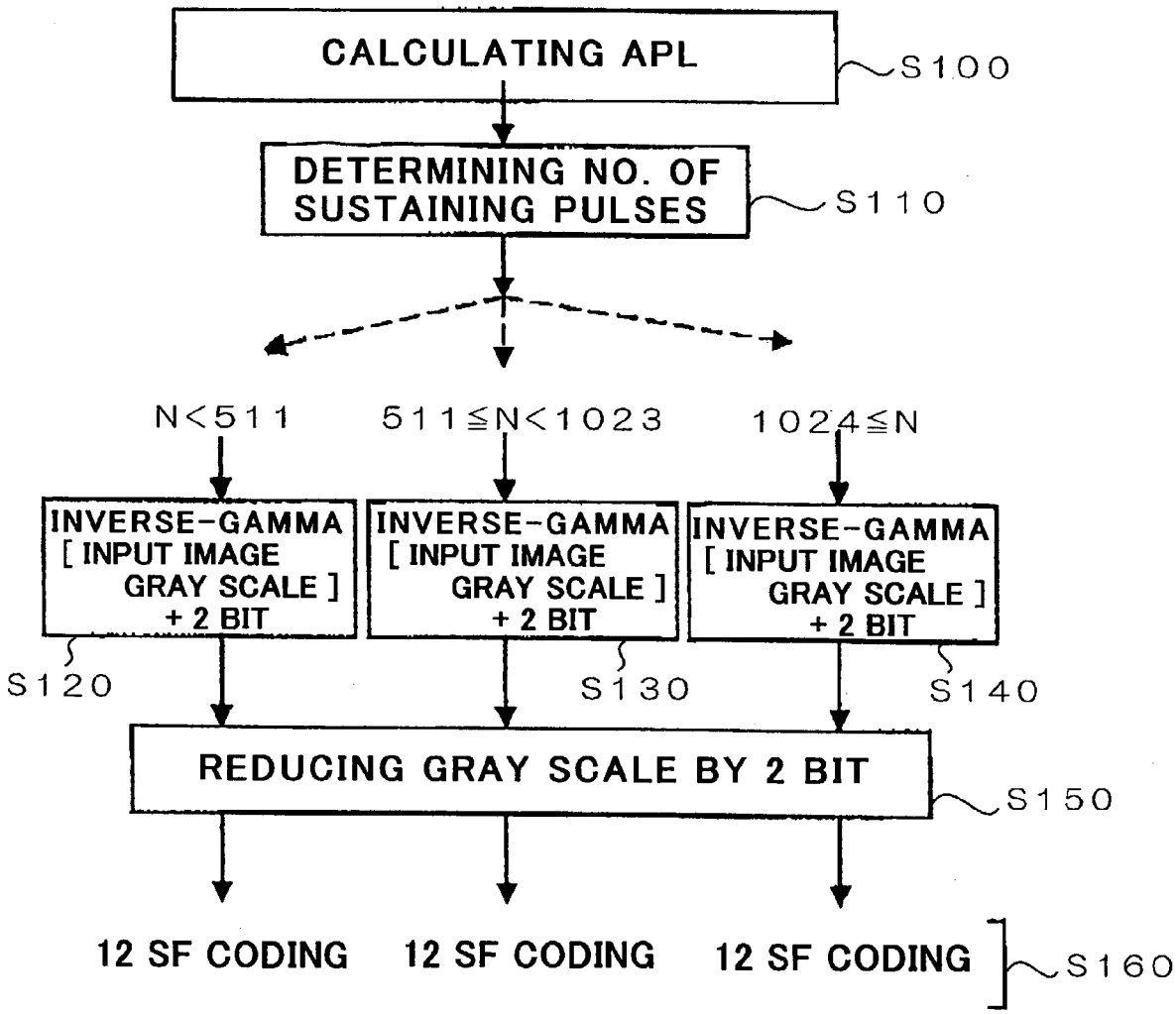
FIG. 11 is a flow chart showing an operation of the block illustrated in FIG. 10.

FIG. 10 is a signal chart showing signals to be received in and transmitted from the inverse-gamma block 2, the error-diffusing block 3 and the sub-field coding block 5, and FIG. 11 is a flow chart showing an operation of the inverse-gamma block 2, the error-diffusing block 3 and the sub-field coding block 5.

Hereinbelow is explained a method of displaying images in the display device 10, with reference to FIGS. 9, 10 and 11.

First, how the output image signal 12 is produced based on the input image signal is explained.

On receipt of the image signal 1, the inverse-gamma block 2 enhances a gray scale resolution of the image signal 1.

For instance, the image signal 1 is comprised of red (R), green (G) and blue (B) signals each having 8 bits, and non-linear conversion is applied to the image signal 1 in the inverse-gamma block 2 in accordance with the following equation (A).

$$y=x^{2.2} \tag{A}$$

In order to prevent degradation of a gray scale caused by the non-linear conversion, a signal to be output from the inverse-gamma block 2 is generally extended by about 2 bits relative to the input image signal 1, that is, a signal to be output from the inverse-gamma block 2 is extended to a 10-bit signal.

The error-diffusing block 3 receives a signal 1*a* output from the inverse-gamma block 2. If the signal 1*a* output from the inverse-gamma block 2 is a 10-bit signal, for instance, the error-diffusing block 3 spatially diffuses the lowest two bits among the 10-bit gray scale resolution, and thus, outputs a 8-bit image signal 1*b* to APL calculating block 4.

On receipt of the image signal 1*b* from the error-diffusing block 3, the APL calculating block 4 transmits the received image signal 1*b* to the sub-field coding block 5 without applying any process to the image signal 1*b*, and further, calculates an average picture level (APL) 8 of images indicated by the received image signal 1*b*.

The average picture level 8 calculated by the APL calculating block 4 is transmitted to the drive control block 7. The drive control block 7 converts the received average picture level 8 into the number 9 of sustaining pulses in dependence on which a luminance of images is determined, and transmits the number 9 of sustaining pulses to a plasma display panel (not illustrated) as a sustaining pulse output signal 11.

The drive control block 7 transmits the number 9 of sustaining pulses to the inverse-gamma block 2 and the sub-field coding block 5.

A relation between the average picture level 8 and the number 9 of sustaining pulses is generally defined by a power source neck. Herein, it is assumed that an average picture level obtained when white is displayed all over a display screen is equal to 100%, and an average picture level obtained when black is displayed all over a display screen is equal to 0%. A peak luminance is in proportion to the number 9 of sustaining pulses. Power consumption is maximum generally when white is displayed all over a display screen. It is assumed that the number 9 of sustaining pulses obtainable in view of power source capability is equal to 256, in other words, it is assumed that the number 9 of sustaining pulses obtainable when an average picture level (APL) is equal to 100% is equal to 256.

As an extreme example, it is assumed that consumed power is constant. When an average picture level (APL) is equal to 50%, the number 9 of sustaining pulses is equal to 512 (256×(100/50)). When an average picture level (APL) is equal to 25%, the number 9 of sustaining pulses is equal to 1024 (256×(100/25)). Hence, an image having an average picture level greater than 50% can be displayed at 256 gray scales (8-bit), an image having an average picture level greater than 25% and smaller than 50% can be displayed at 512 gray scales (9-bit), and an image having an average picture level equal to or smaller than 25% can be displayed at 1024 gray scales (10-bit).

The image signal 1*c* transmitted to the sub-field coding block 5 from the APL calculating block 4 is converted into sub-field coding data in accordance with which an image is displayed at a certain gray scale on a plasma display panel.

For instance, in a general plasma display panel, the sub-field coding block 5 converts a 8-bit image signal into twelve sub-field coding data.

The sub-field coding data 1*d* transmitted from the sub-field coding block 5 is converted into the output image signal 12, and output to a plasma display panel through the frame memory 6.

A plasma display panel receives both the output image signal 12 from the frame memory 6 and the sustaining pulse output signal 11 from the drive control block 7, determines pixels in which a light is to be emitted and an intensity with which a light is to be emitted, and displays images.

Hereinbelow is explained an operation of the inverse-gamma block 2, the error-diffusing block 3 and the sub-field coding block 5 while the display device 10 in accordance with the first embodiment operates, with reference to FIG. 10.

On receipt of the image signal 1 having 8 bit, the inverse-gamma block 2 varies the number of bits of its output image signal 1*a*, specifically, varies the 8-bit signal into a 10-bit, 11-bit and 12-bit signals, for instance.

The error-diffusing block 3 carries out error diffusion of 2 bit to the 10-bit, 11-bit and 12-bit image signals 1*a* transmitted from the inverse-gamma block 2. For instance, the error-diffusing block 3 carries out Floyd-Steinberg type error diffusion. As a result, the 10, 11 and 12-bit image signals 1*a* are changed into 8, 9 and 10-bit image signals. The error-diffusing block 3 outputs the 8, 9 and 10-bit image signals 1*c* to the sub-field coding block 5.

On receipt of the image signals 1*c*, the sub-field coding block 5 codes the received 8, 9 and 10-bit image signals 1*c* to 12 sub-fields, and outputs the thus sub-field coded signal 1*d* to the frame memory 6.

In the first embodiment, Floyd-Steinberg type error diffusion is carried out in the error-diffusing block 3 as an example of spatial diffusion. However, it should be noted that any process may be carried out in place of Floyd-Steinberg type error diffusion, if the process spatially diffuses a gray scale of an image signal. For instance, dither process may be carried out in place of Floyd-Steinberg type error diffusion.

Hereinbelow are explained how the inverse-gamma block 2 receives 8-bit image signals and outputs signals having different bits from each other, and how the sub-field coding block 5 selects another sub-field coding, with reference to FIG. 11.

The APL calculating block 4 calculates an average picture level (APL), based on the image signal 1*b* transmitted from the error-diffusing block 3, in step S100.

The average picture level (APL) 8 calculated by the APL calculating block 4 is transmitted to the drive control block 7, and converted into the number of sustaining pulses in the drive control block 7, in step S110.

A gray scale resolution to be displayed at a plasma display panel is determined based on the number of sustaining pulses.

Specifically, if the number N of sustaining pulses is smaller than 511 ($N<511$), it would be impossible to display image at 9 bit or 512 gray scales or greater. The inverse-gamma block 2 raises the number of bits of the 8-bit image signal by two, and thus, transmits a 10-bit image signal to the error-diffusing block 3, in step S120.

If the number N of sustaining pulses is equal to or greater than 511, but smaller than 1023 ($511 \leqq N<1023$), it would be possible to display image at 9 bit, but it would be impossible to display image at 10 bit or greater. Hence, the inverse-gamma block 2 raises the number of bits of the 8-bit image signal by three, and thus, transmits a 11-bit image signal to the error-diffusing block 3, in step S130.

If the number N of sustaining pulses is equal to or greater than 1024 ($1024 \leqq N$), it would be possible to display image at 10 bit or greater. Hence, the inverse-gamma block 2 raises the number of bits of the 8-bit image signal by four, and thus, transmits a 12-bit image signal to the error-diffusing block 3, in step S140.

The thus produces 10, 11 and 12-bit image signals are output to the error-diffusing block 3, which carries out 2-bit error diffusion (for instance, Floyd-Steinberg type error diffusion) to the image signals, in step S150. The 10, 11 and 12-bit image signals are converted into 8, 9 and 10-bit image signals through the error diffusion, and the thus produced 8, 9 and 10-bit image signals are transmitted to the sub-field coding block 5 through the APL calculating block 4.

The sub-field coding block 5 codes the 8, 9 and 10-bit image signals to twelve sub-fields, in step S160.

As mentioned above, the number of bits of a signal transmitted from the inverse-gamma block 2 is determined, and the number of bits of a signal input into the sub-field coding block 5, and hence, how an image signal is sub-field coded (for instance, 8-bit input and 12 sub-fields output, 9-bit input and 12 sub-fields output, and 10-bit input and 12 sub-fields output) are selected, based on the number 9 of sustaining pulses. Thus, it is possible to display image at a maximum gray scale resolution within an allowable range defined by characteristics of a plasma display panel.

The number of sub-fields to be displayed in a plasma display panel is determined to be twelve (12) in the first embodiment. However, it should be noted that the number of sub-fields to be displayed in a plasma display panel may be varied in dependence on characteristics of the plasma display panel.

In addition, since an average picture level is determined in each of frames of the input image signal 1, it is possible to vary a gray scale resolution for each of frames of the input image signal 1.

[Second Embodiment]

In the above-mentioned first embodiment, the number of sub-fields to be displayed in a plasma display panel is determined to be fixed. As an alternative, a difference between the number 9 of sustaining pulses and the number of bits of a signal to be sub-field coded may be determined to be fixed, which suppresses generation of a pseudo-framing line to some degree.

However, if the number of sub-fields is increased, it would be necessary to shorten a period of scanning time for writing lower bits in order to prevent an increase in a period of writing time. This might result in an increase in writing defectiveness. In order to keep balance between writing defectiveness and prevention of generation of pseudo-framing lines, it would be necessary to determine the number of sub-fields to be determined when the number of sustaining pulses is relatively great, to be equal to or greater than the number of sub-fields to be determined when the number of sustaining pulses is relatively small.

In addition, an average picture level (APL) of the image signal 1 is detected before it is input into the inverse-gamma block 2, and is compared to average picture levels of frames located before and after a target frame. Only when a difference between the detected average picture level and the average picture levels of the frames located before and after a target frame is greater than a predetermined threshold, the display device in accordance with the second embodiment may be used, and, on the other hand, if the difference is smaller than the predetermined threshold, the number of bits of the output signal 1*a* transmitted from the inverse-gamma block 2 and the number of bits of the image signal 1*c* to be input into the sub-field coding block 5 may be kept unchanged.

Specifically, assuming that the number of sub-fields is S1 when the number of sustaining pulses is equal to A and the number of sub-fields is S2 when the number of sustaining pulses is equal to B ($A>B$), the numbers S1 and S2 are determined such that the number S1 is equal to or greater than the number S2 ($S1 \geqq S2$).

Though the display devices in accordance with the first and second embodiments are applied to a plasma display device (PDP), the display devices may be applied to all of devices which operate in accordance with a sub-field process. For instance, the display devices in accordance with the first and second embodiments may be applied to a digital micro-mirror device (DMD) or an electroluminescence device. Herein, an electroluminescence device includes an organic one and an inorganic one.

An operation of the display device in accordance with the first or second embodiment can be accomplished by a computer program written in a language readable by a computer.

For operating the display device by means of a computer program, the display device 10 is designed to include a memory to store the computer program therein, and a controller such as a central processing unit, for instance. The computer program is stored in the memory, and is read out into the controller when the controller starts its operation. Thus, such an operation of the display device 10 as mentioned above is accomplished in accordance with the computer program.

As an alternative, a recording medium storing such a computer program as mentioned above may be set into the controller to be read out by the controller.

The functions of the display device 10 may be accomplished as a program including various commands, and be presented through a recording medium readable by a computer.

In the specification, the term "recording medium" means any medium which can record data therein.

The term "recording medium" includes, for instance, a disk-shaped recorder such as CD-ROM (Compact Disk-ROM) or PD, a magnetic tape, MO (Magneto Optical Disk), DVD-ROM (Digital Video Disk-Read Only Memory), DVD-RAM (Digital Video Disk-Random Access Memory), a floppy disk, a memory chip such as RAM (Random Access Memory) or ROM (Read Only Memory), EPROM (Erasable Programmable Read Only Memory), EEPROM (Electrically Erasable Programmable Read Only Memory), smart media (Registered Trade Mark), a flush memory, a rewritable card-type ROM such as a compact flush card, a hard disk, and any other suitable means for storing a program therein.

A recording medium storing a program for accomplishing the above-mentioned display device may be accomplished by programming functions of the above-mentioned display device with a programming language readable by a computer, and recording the program in a recording medium such as mentioned above.

A hard disc equipped in a server may be employed as a recording medium. It is also possible to accomplish the recording medium in accordance with the present invention by storing the above-mentioned computer program in such a recording medium as mentioned above, and reading the computer program by other computers through a network.

As a computer, there may be used a personal computer, a desk-top type computer, a note-book type computer, a mobile computer, a lap-top type computer, a pocket computer, a server computer, a client computer, a workstation, a host computer, a commercially available computer, and electronic exchanger, for instance.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Applications No. 2002-107451 and No. 2003-068368 filed on Apr. 10, 2002and Mar. 13, 2003, respectively, including specification, claims, drawings and summary is incorporated herein by reference in its entirety.

What is claimed is:

1. A display device which displays images corresponding to an input image signal in accordance with a sub-field method, comprising:

(a) a first block which receives an image signal, varies the number of bits of the received image signal, and outputs the resulting image signal;

(b) a second block which calculates an average picture level (APL) of an image defined by said image signal transmitted from said first block;

(c) a third block which receives said image signal from said second block, converts the received image signal into sub-field coding data, and outputs said sub-field coding data to a display panel; and (d) a fourth block which receives said average picture level from said second block, converts the received average picture level to the number of sustaining pulses, transmits a sustaining pulse output signal representing said number of sustaining pulses to said display panel, and transmits said number of sustaining pulses to said third block, wherein said third block selects a number of bits of a signal to be input thereto, in accordance with said number of sustaining pulses received from said fourth block.

2. The display device as set forth in claim 1, further comprising a fifth block which receives said image signal from said first block, applies a signal process to lower bits of said image signal for spatially diffusing gray scales of images, and outputs the resulting image signal to said third block, wherein said first block selects a number of bits of a signal to be output therefrom, in accordance with said number of sustaining pulses received from said fourth block.

3. The display device as set forth in claim 2, wherein said signal process is at least one of error-diffusion process and dither process.

4. The display device as set forth in claim 2, wherein said fifth block carries out Floyd-Steinberg type error diffusion.

5. The display device as set forth in claim 1, wherein when said number of sustaining pulses is equal to A, said third block sets said number of bits of a signal to be input thereto, equal to or greater than another number of bits of a signal to be input thereto, said another number of bits being set when said number of sustaining pulses is equal to B that is smaller than A (B<A).

6. The display device as set forth in claim 1, wherein:

when said number of sustaining pulses is equal to A, said first block sets a number of bits of a signal to be output therefrom equal to or greater than another number of bits of a signal to be output therefrom, said another number of bits being set when said number of sustaining pulses is equal to B that is smaller than A (B<A); and when said number of sustaining pulses is equal to A, said third block sets said number of bits of a signal to be input thereto equal to or greater than another number of bits of a signal to be input thereto, said another number of bits being set when said number of sustaining pulses is equal to B that is smaller than A (B<A).

7. The display device as set forth in claim 1, wherein a number of sub-fields is determined in accordance with said number of sustaining pulses.

8. The display device as set forth in claim 7, wherein when said number of sustaining pulses is equal to A, said number of sub-fields is set equal to or greater than another number of sub-fields, said another number of sub-fields being set when said number of sustaining pulses is equal to B that is smaller than A (B<A).

9. The display device as set forth in claim 7, wherein said number of sub-fields is capable of being fixed regardless of said number of sustaining pulses.

10. The display device as set forth in claim 1, wherein said display device is comprised of a plasma display panel (PDP).

11. The display device as set forth in claim 1, wherein said display device is comprised of a digital micro-mirror device (DMD).

12. The display device as set forth in claim 1, wherein said display device is comprised of an electroluminescence (EL) device.

13. The display device as set forth in claim 1, wherein said number of bits of a signal to be output from said first block and said number of bits of a signal to be input to said third block are altered only when a scene defined by the received image signal changes.

14. The display device as set forth in claim 1, wherein said number of bits of a signal to be output from said first block and said number of bits of a signal to be input to said top block are altered when said average picture level varies to a degree beyond a predetermined threshold.

* * * * *